United States Patent [19]

Alheid

[11] 4,357,370

[45] Nov. 2, 1982

[54] TWIN SHORT DWELL COATER ARRANGEMENT

[75] Inventor: Robert J. Alheid, Beloit, Wis.

[73] Assignee: Beloit Corporation, Beloit, Wis.

[21] Appl. No.: 248,241

[22] Filed: Mar. 27, 1981

[51] Int. Cl.[3] ..... B05D 3/12; B05C 1/00; B05C 3/02

[52] U.S. Cl. ..... 427/211; 118/206; 118/248; 118/259; 118/261; 118/407; 118/410; 118/411; 118/413; 427/356; 427/361; 427/428

[58] Field of Search ..... 118/206, 218, 220, 225, 118/226, 227, 248, 255, 259, 261, 413, 407, 410, 411; 427/356, 358, 361, 428, 209, 211

[56] References Cited

U.S. PATENT DOCUMENTS 2,796,846 6/1957 Trist ..... 118/415 X 3,348,526 10/1967 Neubauer ..... 118/410

3,484,279 12/1969 Clark ..... 427/356

3,489,592 1/1970 Wallsten ..... 117/68

4,250,211 2/1981 Damrau et al. ..... 118/413 X

FOREIGN PATENT DOCUMENTS 2425277 12/1979 France ..... 118/261

*Primary Examiner*—Michael R. Lusignan

*Attorney, Agent, or Firm*—Hill, Van Santen, Steadman, Chiara & Simpson

[57] ABSTRACT

A coater for applying a coating material to both sides of a traveling web with the web passed over a back-up roll and a first coating such as sizing applied to the back-up roll surface in advance of a coating zone for transfer to the web at the coating zone and the second surface of the web being coated by a trailing blade coater applying pressure to the web urging it against the back-up roll.

10 Claims, 1 Drawing Figure

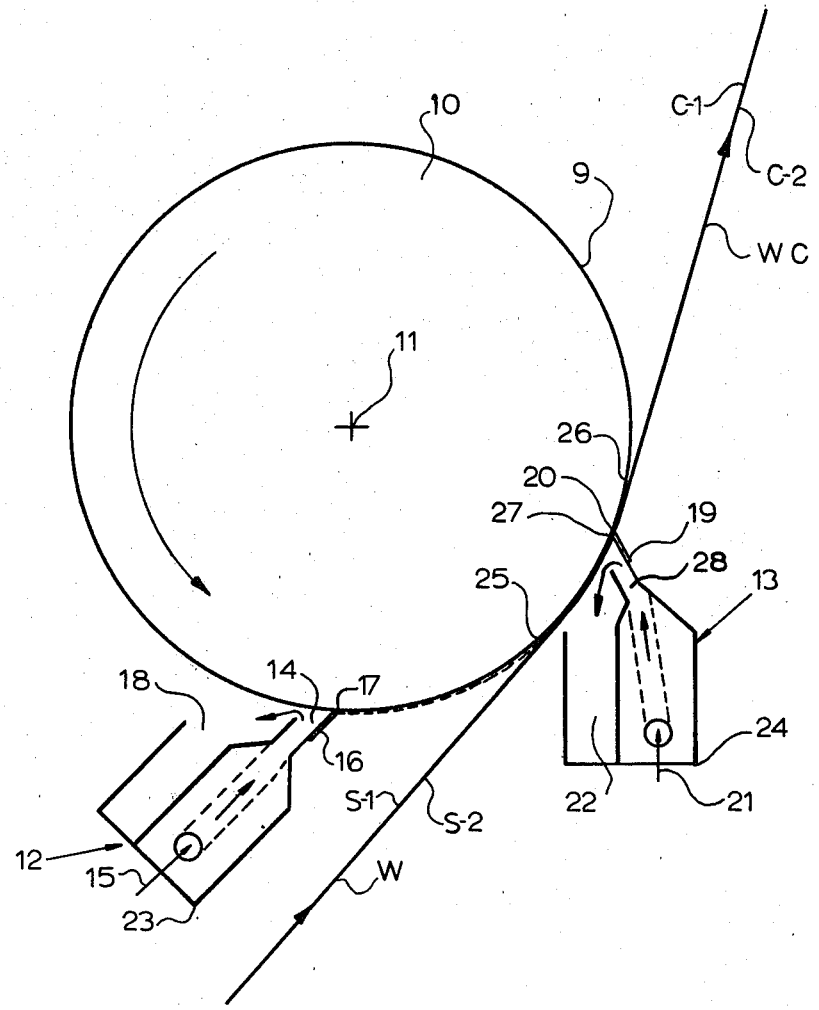
10
9
C-1
C-2
W C
11
26
20
27
19
28
13
25
18
14
17
16
24
22
21
S-1
S-2
12
15
23
W

TWIN SHORT DWELL COATER ARRANGEMENT

BACKGROUND OF THE INVENTION

The present invention relates to improvements in coating mechanisms such as for applying coating to a traveling paper web and particularly to an improved apparatus and method which makes it possible to simultaneously coat both surfaces of a web and makes it possible to apply a sizing to one surface and a coating to the other surface.

The coating of webs, such as paper, paperboard, woven and nonwoven fabrics and so forth, have been carried out in the past employing a variety of different mechanisms and procedures. It has not been common practice to be able to apply a coating to both surfaces of a traveling web essentially simultaneously, although one such attempt is disclosed in U.S. Pat. No. 3,489,592, Wallsten. The structure shown in this patent requires the limitations of a downrunning arrangement with opposing blades, and the structure shown is not capable of sophisticated high speed operation which can apply various types of coatings to obtain a finished paper. One particular problem has been to be able to apply a sizing to one surface of a traveling paper web and apply a coating to the other surface. Broadly speaking, sizing employs starches whereas coating uses pigment such as clay. It will be understood that while the present invention attains particular advantages in the application of a sizing to one surface of a paper web and of a coating to the other surface, the features of the invention may be employed in other ways such as by applying two different forms of coating to opposite sides of the web, although in some cases, the same coating may be applied to the opposite sides of a web. Thus, a feature of the present invention is its capability to handle varying types of coatings and to apply them to both sides of a traveling web essentially simultaneously so that the web is coated in a single operation.

It is another feature of the invention to coat both sides of a traveling web of paper and utilize a sophisticated improved coating structure for the outer surface of the web, such as disclosed in U.S. Pat. No. 3,348,526, Neubauer. This structure utilizes a trailing knife or blade mounted with its working edge pressed against the web where the web passes over the roll. The knife functions to spread the coating composition applied to the web and at the same time meters the material whereby uniform film results. The present invention makes it possible to use a similar type of coating apparatus operating in a different manner to coat the opposite side of the web metering the coating to be applied. Further, there is a coaction between the coating methods applied whereby the coating to each surface is applied in an improved manner obtaining new and unforeseen results in an improved coated paper product.

In a specific embodiment of the invention, a back-up roll is provided in the coater, preferably one with a resilient covering and the outer surface of the web is engaged and coated by an inverted blade or knife mounted in the coater beside the back-up roll with its working edge and the surface of the roll defining a nip in the coater. The blade defines an acute angle on the feed side of the nip with respect to a plane passing tangentially of the surface of the roll at the nip. An extrusion device is mounted on the coater in a position where it is operable to extrude a ribbon of coating material continuously onto the blade adjacent its working edge and the nip defined thereby. The coating material on being deposited on the blade is displaced upwardly along the blade and into the nip by the coating material being continuously extruded from the extrusion device. As the back-up roll is rotated and the web is advanced through the nip, the coating material which fills the nip is spread out in a smooth film on the web being treated. Only enough coating material is extruded so as to produce an excess of coating material at the nip, and excess material is troweled off by the blade during the coating operation then to be caught in a pan or other container once the material may be recirculated to the extrusion device. A structure of this type is shown and disclosed in U.S. Pat. No. 3,348,526, and the present arrangement additionally in a preferred embodiment applies a coating to the back-up roll at a location in advance of where the web is laid on the back-up roll. The coating is applied by a suitable mechanism, such as a trailing blade coater which carefully meters a layer of coating in a uniform layer across the width of the back-up roll. As the coating is carried up into a coating zone, where the web is laid onto the back-up roll, it is transferred off the back-up roll onto the web. This transfer begins immediately as the web contacts the roll, but a unique effect is attained by the hydraulic pressure generated between the back-up roll and the blade. That is, the coating on the back-up roll is still liquid as it passes between the web and the back-up roll, and the coating on the opposite surface of the web is also liquid where it is pressed against the web by the trailing blade coater. The two liquids on the opposite side of the web generate a hydraulic pressure which will tend to be uniform along the length of the blade, and the web in effect floats between two hydraulic layers, with one layer being the coating between the roll and the web and the other layer being the coating between the blade and the web. This hydraulic bath or float brings the web to a neutral position, neutralized by the pressures of the two coatings so that the coating is more uniformly and more evenly applied on both sides of the web. This reaction enhances the operation of the particular type of trailing blade coater which receives its coating by extrusion ahead of the blade edge so that it operates better to provide a better coated product.

The coaction between the two layers of coating also improves the transfer of coating from the back-up roll to the web in that there are no extreme pressure points generated, but the pressure between the inner surface of the web and the back-up roll is essentially uniform across the working length of the roll so that the transfer pressure is essentially uniform. This helps meter a more uniform layer of coating to the undersurface of the web. This also makes possible a more solid surface back-up roll, and it is not as essential to provide a resilient surface on the back-up roll to coact with the blade coater on the undersurface because the hydraulic support or float of the layer of coating between the web and the back-up roll provides the resiliency which is necessary.

Further because a uniform hydraulic resistance is occurring on both sides of the web at the same location, penetration of the coating on the outer surface and of the sizing on the undersurface is more likely to be uniform, and the coating and the sizing are more likely to remain on the surface rather than migrate at an undesirable distance into the moving web. Such an effect, of course, conserves coating and provides a coating layer on the outer surface of the web which is more suitable.

An object of the invention is to provide an improved coating mechanism for achieving an improved coaction between the coating applicator and the traveling paper web for an improved product.

A further object of the invention is to provide an improved coater capable of simultaneously applying a sizing to one surface of a traveling web of paper and a coating to the opposite side or applying coatings of different characteristics to the two sides of a traveling paper web in substantially the same operation.

A still further object of the invention is to provide an improved coating apparatus and a method of applying coating utilizing hydraulic forces which are present by liquid coating on both sides of the paper with the coating being simultaneously applied to the paper.

Other objects, advantages and features will become more apparent with the teaching of the principles of the invention in connection with the disclosure of the preferred embodiments in the specification, claims and FIGURE, in which:

DESCRIPTION OF THE FIGURE

The FIGURE is an end elevational view shown in schematic form of a coating mechanism constructed and operating in accordance with the principles of the present invention.

DESCRIPTION OF THE PREFERRED EMBODIMENT

As illustrated on the FIGURE, a back-up roll 10 is provided which is rotationally supported for rotation on its axis 11. Suitable means, not shown, may be provided to drive the roll in rotation at the speed of travel of the traveling web W. The outer surface 12 of the roll is smooth, and the roll may have a rubber, plastic or metal surface and is preferably slightly resilient.

The web travels in an upward direction carried on suitable rolls, not shown, and is laid onto the back-up roll 10 to be supported thereon in a coating zone which extends from location 25 to location 26 wherein the web continues its travel for drying of the coating, winding and other possible processing.

For coating the undersurface of the web, surface $S_1$, coating is applied directly to the outer surface of the back-up roll at a location in advance of the point 25 where the web engages the roll. This coating may be applied to the surface of the roll by various means which are capable of applying a uniform measured layer onto the roll surface. Preferably, however, the coating is applied by a trailing blade mechanism as indicated generally by the numeral 12 for the first applicator means.

Coating is applied to the other surface $S_2$ of the traveling web by a second coating applicator means 13.

The preferred form of first applicator means has a coating flow throat 14 to which coating is supplied by suitable conduits and lines 15, and the coating comes into contact with the surface 12 of the roll and is metered by the trailing edge 17 of a resilient blade 16. The blade is suitably supported on a coating doctor back 23. Excess coating overflows into a channel 18 where it is carried away for recirculation. The doctor back 23 is provided with mechansim for rotation so that the blade 16 can be pressed against the roll with a suitable force for metering the coating.

The coating which is applied to the surface $S_1$ is preferably a sizing, and the device shown finds particular advantage with such coating making it possible to apply a sizing to one surface and a coating to the other surface at the same time. The coating is carried on the surface of the roll from the trailing end 17 of the blade up to where it comes into engagement with the surface $S_1$ of the web at location 25 at which point the coating begins transferring to the web.

The other surface $S_2$ of the web has coating applied by the second applicator means 13 which includes a doctor back 24 supporting a trailing doctor blade 19 with an edge 20 and metering smoothing engagement with the surface $S_2$ of the web. Coating is supplied by a suitable conduit means and lines 21 to a throat 28 where it is extruded out onto the undersurface of the blade 19. Excess coating overflows into a channel 22 where it is recirculated.

While the second applicator 13 is shown somewhat schematically, it will be understood that in a preferred form, it will have the structure disclosed in the aforementioned patent 3,348,526, the disclosure of which is embodied herein in its entirety by reference.

A unique coaction occurs at the blade tip 20 at the location 27. Thus, the sizing which is on the surface 12 of the roll beneath the web forms a hydraulic seat or base for the web, and the coating which is on the outer surface of the web forms a hydraulic pressure area urged by the blade 19. This essentially permits the web to float between the two layers of coating, the one on the surface $S_1$ and the other on the surface $S_2$. This hydraulic float will essentially make the pressure between the coatings and the web uniform along its length. This will insure a more uniform application of the coating on each surface of the web. It will also insure more uniform transfer of the sizing from the roll surface 12 to the surface $S_1$ of the web. The resultant coating of the outer surface will be more uniform and more smooth. There will be less areas of too much penetration thus insuring that the coating will form a more uniform surface layer and reducing coating consumption.

As the web continues to travel to location 26 which is the end of the coating zone, it separates from the back-up roll and has a coating of sizing shown by layer C1 and a coating on the outer surface shown by the layer C2 with the coated web designated by the letters WC.

Thus, it will be seen that I have provided an improved coating apparatus and method which achieves the advantage and objectives hereinabove set forth and utilizes the very coating operation to improve itself and provide an improved product.

I claim as my invention:

1. Apparatus for applying coating to both surfaces of a moving web comprising in combination:

means for advancing the web including back-up means having a back-up surface for receiving and supporting a first surface of the web as the same is advanced on the back-up surface;

a first applicator means positioned for applying a first coating to said back-up surface in advance of a location where the back-up surface receives the web so that the coating coats the first surface of the web transferring the coating from the back-up surface to the web while the web is supported as it travels through a coating zone;

a second applicator means comprising blade mounting means and an inverted blade with the latter forming with the lower face of the web, where such web is supported on the back-up means;

means defining an elongated pocket extending transversely of the web for receiving a second coating material to be applied to the web, which pocket is open along a longitudinally extending side of the pocket facing the web as it advances into the pocket;

said blade including a blade body bounded along one margin by working edge, said blade being mounted on said blade mounting means with the blade body extending downwardly from said working edge and with the working edge disposed adjacent the backing surface and extending transversely of the web thereby to define a nip through which the web travels while being coated with said web being pressed against the sizing in the coating zone while the web is on the back-up in said zone;

said applicator means further comprising extrusion means defining an elongated extrusion opening spaced a short distance below and substantially parallel to said working edge and in a position where material extruded through such opening is directed as an extruded ribbon upwardly against said blade body and said web, with such ribbon supported on one face only and such support being supplied by said blade body, said extrusion means further including means defining a chamber for coating material communicating with said extrusion opening, said applicator means being devoid of support for the opposite face of such extruded ribbon in a region extending from the extrusion opening to said backing surface; and means for supplying coating material to said chamber.

2. Apparatus for applying coating to both surfaces of a moving web constructed in accordance with claim 1:

wherein said first applicator means includes a trailing blade supported with the trailing edge of the blade in close running engagement with the backup means; and said first applicator means also including means for supplying the first coating to the nip between the blade and the back-up surface.

3. Apparatus for applying coating to both surfaces of a moving web constructed in accordance with claim 1:

wherein said first applicator means applies a sizing to the back-up surface.

4. Apparatus for applying coating to both surfaces of a moving web constructed in accordance with claim 1:

wherein said second applicator means instead comprises blade mounting means and an inverted blade with the latter forming with the lower face of the web where such web is supported on the back-up means;

means defining an elongated pocket extending transversely of the web for receiving a second coating material to be applied to the web, which pocket is open along the longitudinally extending side of the pocket which faces the web as it advances it into the pocket;

said blade including a blade body bounded on one margin by a working edge, said blade being mounted on said mounting means with the blade body extending downwardly from said working edge and with the working edge thereof disposed adjacent the backing surface and extending transversely of the web thereby to define a nip through which the web travels while being coated;

said second applicator means further comprising extrusion means including an elongated cover plate adjacent said blade mounting means forming with said mounting means a chamber for coating material located between the cover plate and blade mounting means, said cover plate having an upper edge closely adjacent the mounting means and said blade body, and said upper edge forming an elongated extrusion opening disposed a short distance below and substantially parallel to the working edge in a position where material extruded through the opening is directed as an extruded ribbon upwardly against said blade body and said web with such ribbon supported on one face only and such support being supplied by said blade body; and means for supplying coating material to said chamber.

5. Apparatus for applying coating to both surfaces of a moving web constructed in accordance with claim 1:

wherein said back-up means is in the form of a substantially horizontal rotatable backing roll with a cylindrical back-up surface; and wherein said second applicator means instead comprises blade mounting means and an inverted blade with the latter forming with the web on the upwardly moving side of the roll where the web is supported on the roll an elongated pocket substantially paralleling the axis of the roll for receiving a second coating material to be applied to said web, which pocket is open along a longitudinally extending side of the pocket which faces the web as it advances into the pocket;

said blade including a blade body bounded along one margin by a working edge, said blade being mounted on said blade mounting means with the blade body extending downwardly from said working edge and with the working edge substantially paralleling the axis of the roll and disposed adjacent the surface of said roll to define a nip through which the web travels while being coated;

said applicator means further comprising extrusion means including an elongated cover plate adjacent said blade mounting means forming with said mounting means a chamber for coating material located between the cover plate and blade mounting means, said cover plate having an upper edge closely adjacent the mounting means and said blade body, and said upper edge forming an elongated extrusion opening disposed a short distance below and substantially parallel to the working edge in a position where material extruded through said opening is directed as an extruded ribbon upwardly against said blade body and said web with such ribbon supported on one face only and such support being supplied by said blade body; and means for supplying coating material to said chamber.

6. Apparatus for applying a coating to both surfaces of a moving web comprising in combination:

means for advancing the web including a cylindrical horizontal back-up roll having a smooth back-up surface for receiving and supporting a first surface of a web as the web is advanced;

first applicator means positioned ahead of the location where the web engages the roll and applying a first coating to the surface of the roll so that the coating is transferred to a first surface of the web in a coating zone; and a second applicator means having means for applying a coating to the second surface of the web in said coating zone so that the web is coated on both surfaces as it leaves the back-up roll.

7. Apparatus for applying coating to both surfaces of a moving web constructed in accordance with claim 6:

wherein said second applicator means applies a force to the second surface of the web in said coating zone aiding in the transfer of the first coating to the web from the roll surface.

8. Apparatus for applying coating to both surfaces of a moving web constructed in accordance with claim 6:

wherein said second applicator means has a trailing blade with the blade in pressure engagement with the web in said coating zone with means for supplying coating to the web in advance of the trailing edge of said blade so that the blade smooths the layer of coating on the second surface of the web and the blade pressure aids in the transfer of coating from the roll to the first surface of the web.

9. The method of coating both surfaces of a traveling web comprising the steps:

passing the web in engagement with a moving back-up surface, applying a coating to the back-up surface in advance of the location where it is engaged by the web so that coating is transferred from the back-up surface to the web; and applying a coating to the second surface of the web while it is supported by the back-up surface simultaneously applying a force to the web for aiding in the transfer of coating from the back-up surface to the web.

10. The method of coating both surfaces of a traveling web in accordance with the steps of claim 9:

wherein the application of coating to the second surface of the web is by a trailing blade which applies a smoothing force to the second surface for smoothing the coating on the second surface and which forces the web toward the back-up surface aiding in the transfer of coating from the backup surface to the first surface of the web.

* * * * *